US006689230B1

(12) United States Patent
Meyer et al.

(10) Patent No.: US 6,689,230 B1
(45) Date of Patent: Feb. 10, 2004

(54) METHOD AND APPARATUS FOR COOLING HOT-ROLLED SECTIONS

(75) Inventors: Meinert Meyer, Erkrath (DE); Klaus Küppers, Erkrath (DE); Manfred Albedyhl, Mettmann (DE); Bruno Böhmer, Erkrath (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 10 days.

(21) Appl. No.: 09/660,797

(22) Filed: Sep. 13, 2000

Related U.S. Application Data

(60) Continuation-in-part of application No. 09/413,154, filed on Oct. 6, 1999, now abandoned, which is a division of application No. 08/593,604, filed on Jan. 30, 1996, now abandoned.

(30) Foreign Application Priority Data

Feb. 4, 1995 (DE) ..... 195 03 747

(51) Int. Cl.[7] ..... C21D 1/54
(52) U.S. Cl. ..... 148/508; 148/581
(58) Field of Search ..... 148/508, 511, 148/581; 266/80, 87, 96

(56) References Cited

U.S. PATENT DOCUMENTS 4,486,248 A * 12/1984 Ackert et al. ..... 148/145

* cited by examiner

*Primary Examiner*—Scott Kastler
(74) *Attorney, Agent, or Firm*—Friedrich Kueffner

(57) ABSTRACT

A method of cooling on a cooling bed hot-rolled steel sections from rolling heat, wherein the sections, particularly rails, have section parts of different masses arranged at a distance from each other over the cross-section of the section, and an apparatus for carrying out the method. Initially, the heat quantities to be proportionally removed from the different section parts in dependence on their mass and temperature and the quantity of cooling medium required for this removal are determined and computed by using measuring equipment together with a computing unit by means of a computer program. Subsequently, cooling of the different section parts or their masses is carried out in a controlled manner in such a way that the section parts reach with as little time delay as possible the transformation line $A_{r3}/A_{r1}$ during the decomposition of the gamma-mixed crystal into ferrite and/or pearlite while releasing the transformation heat.

4 Claims, 5 Drawing Sheets

1000
900
800
700
600
500
400
300
200
100
0
°C
$Ac_3$
$Ac_1$
$Ar_1$
P
$Z_W$
A
M
$M_s$
757
751
718
365
355
335
306
306
1
2
4
6
8
10
sec
min
100
1000
h
t

METHOD AND APPARATUS FOR COOLING HOT-ROLLED SECTIONS

CROSS-REFERENCE TO RELATED APPLICATIONS

This application a continuation-in-part of application Ser. No. 09/413,154 filed Oct. 6, 1999, abandoned, which is a divisional application of 08/593,604 filed Jan. 30, 1996, now abandoned.

BACKGROUND OF THE INVENTION

1. Field of the Invention

The present invention relates to a method of cooling on a cooling bed hot-rolled steel sections from rolling heat, wherein the sections, particularly rails, have section parts of different masses arranged at a distance from each other over the cross-section of the section; the present invention also relates to an apparatus for carrying out the method.

2. Description of the Related Art

Rails are cooled on cooling beds from the rolling heat to temperatures below 80° C. Because of the asymmetrical arrangement of the masses of the section, different cooling behaviors occur between the head and the base of the rail, wherein the base cools more quickly than the head because the base has larger heat radiation surfaces in relation to the mass thereof. As a result, the rail buckles during cooling. This buckling can be counteracted to a certain extent by pre-bending the rail while it is still in the hot state. However, this procedure has the disadvantage that it requires a complicated hot bending step whose outcome is uncertain. In any event, the rails must be realigned after cooling. The cooling process as well as especially the alignment produce stresses in the rail which disadvantageously influence the strength of the rail. Numerous proposals have become known for effectively counteracting this difficulty.

DE 42 37 991 A1 describes a method for cooling profiled rolling stock, particularly rails, which are hot-rolled in rolling stands, wherein cooling is effected by natural convection or with forced air cooling. The gist of the known method resides in that the rails are transported over the cooling bed with the head hanging downwardly. This measure favorably influences the heat transition conditions already with natural convection in such a way that the temperature difference between head and base of the rail is reduced from about 140° C. when the head of the rail faces up to about 50° C. with the rail hanging facing down. Because of the small temperature difference between head and base, the disadvantages of buckling are effectively reduced and an almost straight rail can be introduced into the straightening machine for final straightening, so that the final stresses in the rail material can be kept extremely low.

German Patent 21 61 704 describes a method and an apparatus for cooling railroad rails in a stress-free and distbrtion-free manner. In accordance with this method, similar rail sections to be cooled are clamped together in pairs base against base, so that the rail bases are arranged next to each other and form abutments for each other, wherein the rails clamped together in this manner are conveyed over a cooling bed by a transverse conveyor. Since each rail head has approximately the same mass as the rail base while the circumference of the rail base is approximately twice that of the rail head, the ratio of the circumferential surface of the clamped-together rail bases relative to their combined mass is about the same as the ratio of the circumferential surface and the mass of the rail head. This results in a uniform cooling of rail heads and rail bases; it has been found in practice that this measure of rail bases resting in pairs against each other is sufficient for an almost distortion-free cooling.

U.S. Pat. No. 468,788 discloses a method for cooling rails in which the rails are immersed entirely or partially in a device with downwardly directed rail heads in a basin filled with water and are cooled in this manner, wherein the rails are simultaneously pressed against a fixed abutment by means of pressure screws.

German Patent 404 127 discloses a method for aligning metal rods having asymmetrical cross-sections, particularly railroad rails, wherein the thicker parts of the cross-section are subjected to a controlled artificial cooling in such a way that all parts shrink by the same extent in spite of the unequal thicknesses and the rods remain straight when cooled down to ambient temperature. This result is achieved by producing the artificial cooling either by immersing the rails in a liquid, by wetting or sprinkling, by blowing a dispersed liquid, by means of steam, air or another gas, wherein the medium used is continuously or intermittently applied during the duration or only during a portion of the cooling period. A significant aspect of this method is the fact that the artificial cooling can be controlled in such a way that the rods are not hardened during cooling even when they are composed of high-carbon steel or a hardenable alloy.

German patent 19 42 929 discloses a method for cooling rails which is based on a different physical principle. In this method, prior to reaching the austenite transformation temperature, the rails are placed at a distance above a heat-reflecting layer on the rail base. In addition, during the further course of cooling, a solid insulation material may be placed on the running surfaces of the rails. A mutual positive influence by radiation is further achieved in this method by placing the rails immediately next to one another, so that the rail bases touch each other at the sides thereof. These measures result in a positive influence on the cooling pattern of each part of the rail cross-section without the supply of outside energy because of reflection at a reflection layer and an insulating cover of the running surfaces. This creates an advantageous stress compensation in the rail cross-section. Placing the rails on the rail base prior to reaching the austenite transformation temperature at a distance above a heat-reflecting layer produces the advantage that an early start of the austenite transformation in the rail base and the rail web are prevented. Consequently, the technological values of the rail material can be influenced individually, i.e., depending on steel analysis, by an exact temperature adjustment in such a way that higher strength values, expansion values and constriction values can be achieved.

The opposite result, i.e., a hardening of the rail head due to an appropriate rapid cooling procedure, is achieved in accordance with French patent 543,461 by subjecting the rail hanging downwardly with the rail base facing up to a series of defined immersion procedures of very short duration in a trough filled with water.

All the above-described methods have the disadvantage that they are based more or less on empirical results, i.e., it is first necessary to carry out extensive tests to determine the parameters that must be maintained while carrying out the method in order to achieve the desired cooling result. These tests require that at least for each charge test pieces of hot-rolled sections are used and that the tests must be repeated when the results are not immediately satisfactory, so that waste material is produced initially in many cases.

SUMMARY OF THE INVENTION

Therefore, it is the primary object of the present invention to improve a method and an apparatus of the above-described type for cooling hot-rolled sections and to perfect the method and the apparatus to such an extent that the above-described difficulties are overcome and a distortion-free cooling result is achieved when cooling from tolling heat without requiring expensive and extensive tests and without producing moist material.

In accordance with the present invention, initially the heat quantities to be proportionally removed from the different section parts in dependence on their mass and temperature and the quantity of cooling medium required for this removal are determined and computed by using measuring equipment together with a computing unit by means of a computer program. Subsequently, cooling of the different section parts or their masses is carried out in a controlled manner in such a way that the section parts reach with as little time delay as possible the transformation line $A_{r3}/A_{r1}$ during the decomposition of the gamma-mixed crystal into ferrite and/or pearlite while releasing the transformation heat.

In accordance with another feature of the invention, the steel section is subjected with its head facing downwardly and its head facing upwardly to a series of defined immersion procedures of very short duration in a trough filled with water.

The method according to the present invention produces the advantageous result that excellent cooling is achieved in different charges without curvature of the section and without requiring expensive empirical experiments.

A further development of the present invention provides that the further cooling from the transformation temperature to a predetermined final temperature is carried out in such a way that the different mass centers of the section reach the final temperature with as little time delay as possible. In addition to an excellent cooling result without curvature of the rail, this measure ensures an optimum temper condition with uniform hardness over the entire cross-section of the section.

In accordance with a useful feature, when the quantities of heat to be removed from the section parts are computed, the transformation temperature of the basic steel quality is taken into consideration.

Another advantageous further development of the invention provides that, when the rolled section or parts thereof are cooled by means of water as the cooling agent, the heat transfer numbers occurring at the different section surfaces are determined and these heat transfer numbers are used for predetermining the quantities of cooling agents required for cooling the section surfaces. This eliminates extensive experiments and lost test material.

In accordance with another advantageous embodiment of the present invention, the rails are guided over a cooling bed with the rail heads facing downwardly and a controlled cooling of the different mass centers is carried out at least partially by natural convection and additionally by the additional use of cooling medium based on the heat quantities to be removed proportionally in dependence on the mass and temperature of the section parts. This reduces a curvature of the section to such an extent that a realignment of the section is either not necessary at all, or only a slight realignment is required which does not produce harmful stresses.

The heat removal may be carried out by directing, preferably intermittently, a spray of cooling medium against the individual section parts.

In order to compensate a temperature wedge which may exist over the length of the section, another feature of the present invention provides that the rolled section is cooled with different intensity over the rolled length.

Finally, a controlled heat removal can also be carried out by immersing the entire rolled section or individual parts thereof in a cooling medium either once or repeated several times with predetermined cycle periods.

An apparatus for carrying out the method according to the present invention includes means for measuring the heat radiation of different section parts, such as, head, web or base. These measuring means are arranged next to a rail preferably spaced apart from each other along the rolling length. The measuring means are connected through data lines to a computing unit in which the dimensions or masses of these section parts are entered with an input data line, and which is programmed in such a way it computes the product of temperature and mass and controls the cooling medium discharge device through a signal line in dependence on this product.

In accordance with a preferred feature of the apparatus, the cooling bed includes controllable cooling medium discharge devices for different cooling media, for example, water, air, water/air mixtures.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
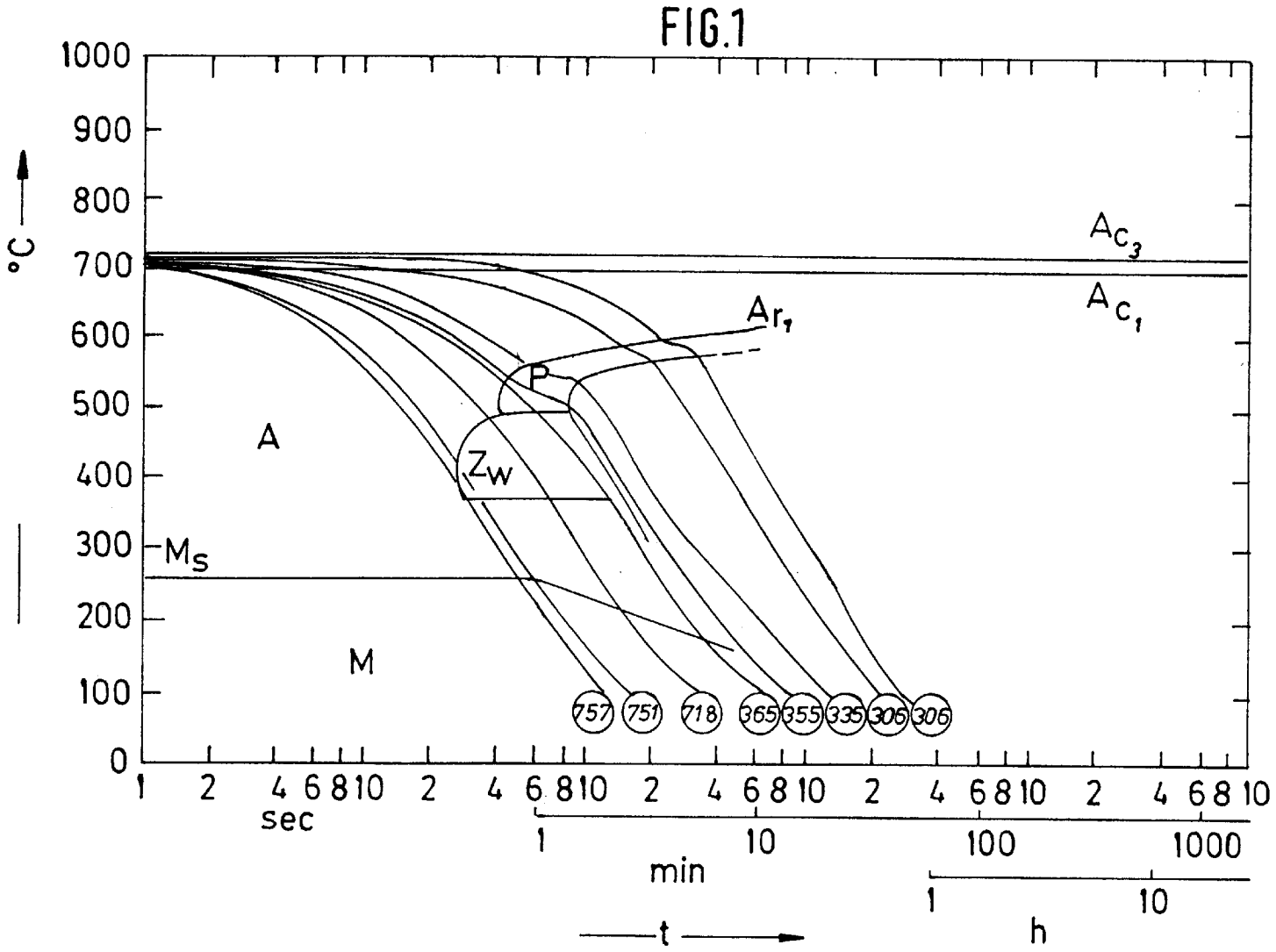
FIG. 1 is a time-temperature transformation diagram of a continuous cooling procedure of a rail piece.

FIG. 1 of the drawing is a time-temperature transformation diagram showing curves of different cooling patterns of various parts of the cross-section of a rail, wherein the different parts reach the transformation line $A_{r1}$ at relatively different times in dependence on their mass and, thus, their temperature centers. The resulting time differences are between 40 and 120 seconds. The diagram concerns a steel having the following metallurgical composition in percent by weight: C=0.63; Si=0.29; Mn=1.72; P=0.020; S=0.027; Cr=0.099. This steel was austenitized at 950° C. with a holding time of 15 minutes after a heating process of 5 minutes.

The following designations are used:

A=Austenite

P=Pearlite

Zw=Intermediate Stage

M=Martensite

It is apparent from the configuration of the curves that, after a sample has been austenitized for 5 minutes at 950° C., the $A_{r1}$ line is reached at a certain temperature and cooling period in the case of a low cooling speed. At higher cooling speeds, the steel does not reach the pearlite line because of a range of sluggish transformation and the transformation occurs at low temperatures in the range of the intermediate stage (bainite) or the transformation occurs at even higher cooling speeds only when reaching the martensite line (about 260° C.). For completing the diagram, the hardness values HV2 in $N/mm^2$ measured at room temperature are entered in the circles provided at the bottom ends of the curves.

It is known that, when steel is cooled and the $A_{r3}$ transformation line or the $A_{r1}$ transformation line are reached, the so-called transformation heat is released by the decomposition of the gamma-mixed crystal into ferrite or pearlite. This transformation heat increases to a maximum with increasing C-content until the eutectoid point (C=0.86%) is reached.

Figure 5:
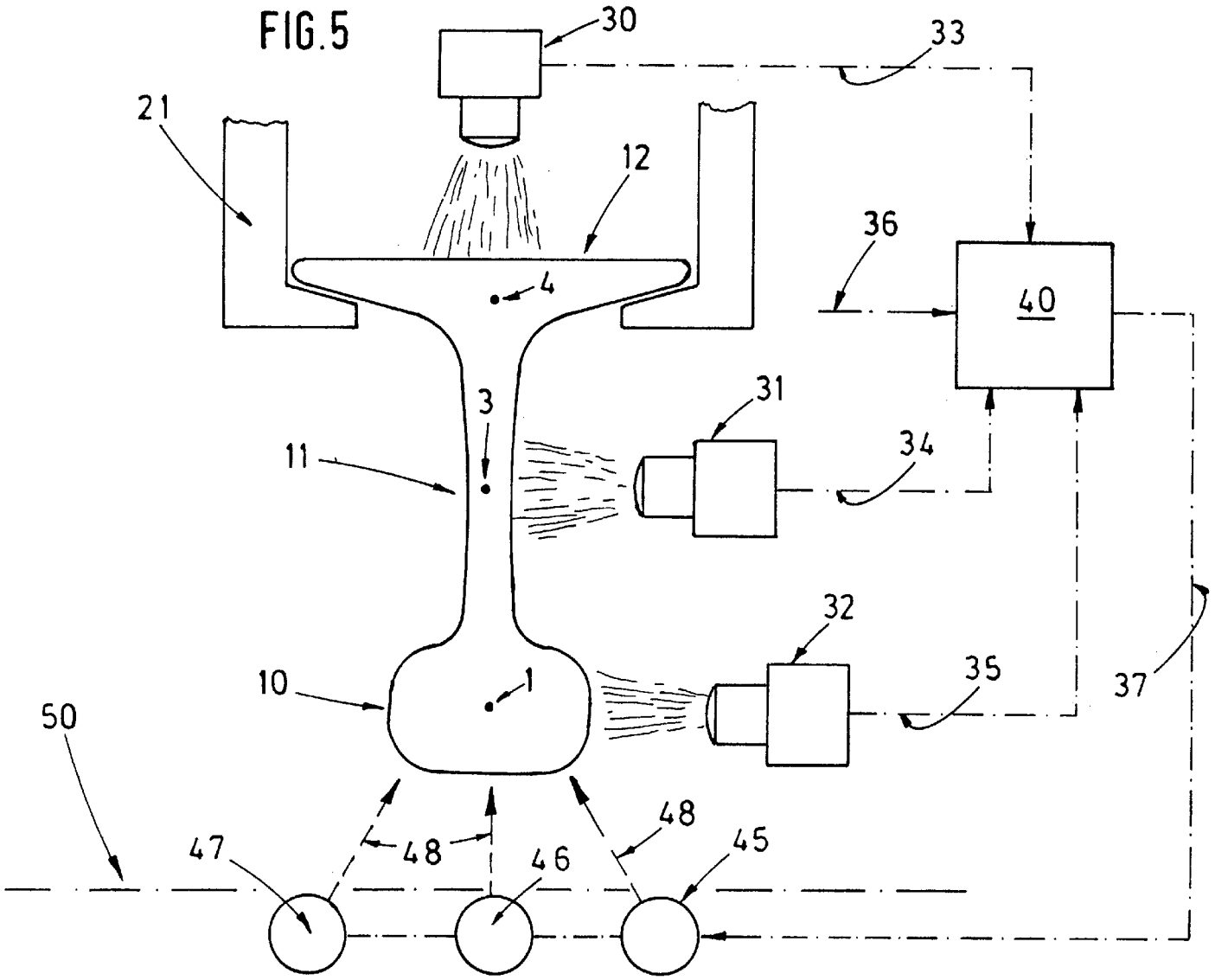
FIG. 5 is a schematic sectional view of a cooling apparatus according to the present invention.

Depending on the cooling speed and the C-content, the released heat may be up to 90 kJ/kg. A length increase of about 0.3% takes place simultaneously with this transformation process. It can be assumed that the known plastic deformations of asymmetric sections on the cooling bed take place predominantly during the above-described transformation phase, while buckling of the section can be observed only at the end of the cooling when compensating the temperatures over the cross-section. The attendant natural stresses cannot be completely eliminated by straightening. In connection with the example of the rail, this process can be explained as follows:

When the rail is cooled after rolling, the base 12 as shown in FIG. 5 initially reaches the transformation line $A_{r3}/A_{r1}$ because of its smaller mass and the greater radiation surface in relation to the mass and the base begins to grow. This change in length leads to a plastic elongation in the rail head 10 which is still in the austenite range. After the transformation, the base 12 shrinks with dropping temperature, wherein the head 10, due to its lower strength, does not significantly prevent the shrinkage of the base 12; rather, the head 10 is slightly upset. When the rail head 10 reaches the transformation line $A_{r3}/A_{r1}$, the growth in length of the rail head 10 begins because of the transformation. However, this growth is suppressed by the colder base 12 which has already been transformed and whose yield point is significantly higher in this temperature range, so that the head 10 which is still softer is plastically deformed, i.e., the head 10 is upset. When the temperatures are equalized over the rail section at the end of the cooling bed 50, the rail begins to buckle over the upset and shorter head 10. This buckling or curvature may be so large in long rails that there occur significant difficulties during the further transportation over the cooling bed 50 and the subsequent insertion into a straightening machine.

In the following, the computation and procedure of the cooling method according to the present invention will be explained in connection with the example of a rail.

Figure 2:
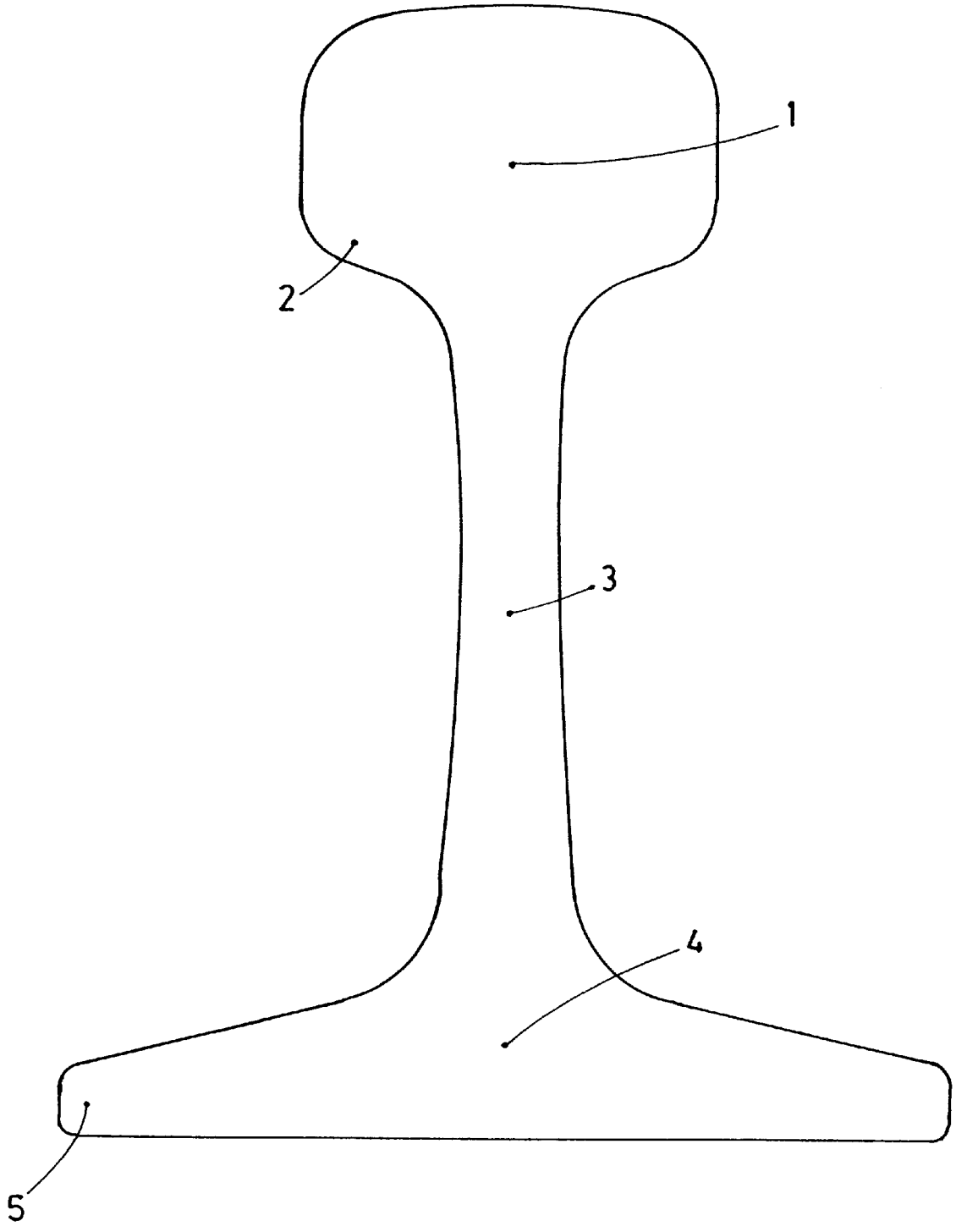
FIG. 2 is a cross-section of a rail with thermoelements embedded in the rail.

FIG. 2 of the drawing shows a cross-section of a rail in approximately actual size, wherein the rail piece is equipped with thermoelements at the locations indicated by numbers 1 through 5. The rail piece is austenitized in a furnace at 1000° C. and is subsequently cooled in air with natural convection. The cooling pattern at the individual measuring locations 1 to 5 is recorded in diagram.

Figure 3:
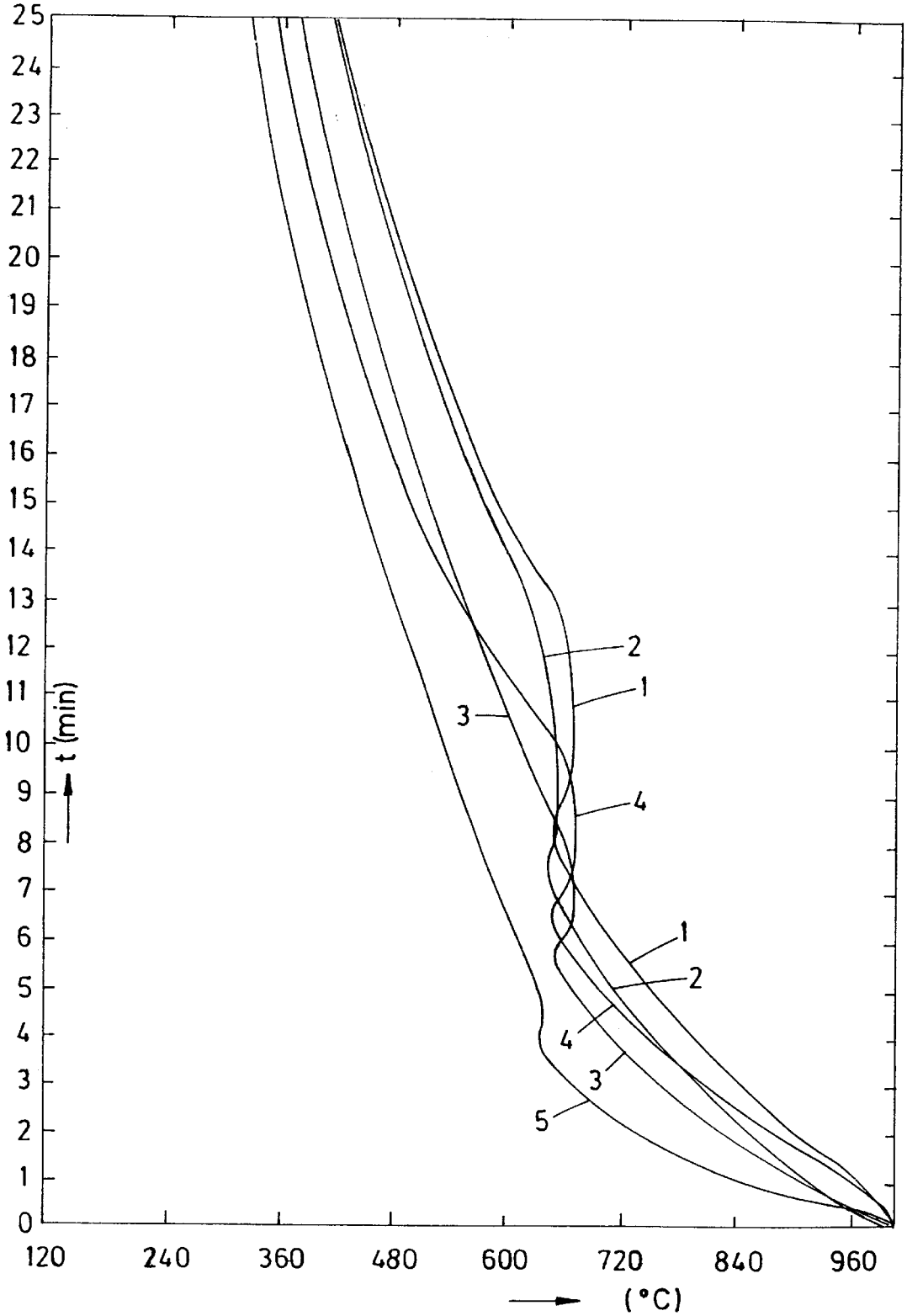
FIG. 3 is a diagram showing the cooling pattern at individual measuring points according to FIG. 2 when cooling the rail piece with natural convection.

This diagram is shown in FIG. 3. In FIG. 3, individual curves show the cooling patterns at the measuring locations 1 to 5 in accordance with FIG. 2. The diagram shows that, when cooling by means of natural convection without additional cooling means, for example, for the head 10, the mass center 4 of the base 12 reaches the $A_{r3}/A_{r1}$ line after about 6.5 minutes and the transformation is concluded after 10 minutes. The transformation of the mass center 1 of the head 10 begins only after about 8.5 minutes and the transformation of the head 10 is concluded after 12 minutes. At this point in time, the rail base 12 is already cooler by about 100° C. and, thus, has a substantially higher hot yield point than the rail head 10. Consequently, it can be expected that the increase in length of the rail head 10 resulting from the transformation is completely or partially suppressed by the base 12, and as a result, the rail head 10 is plastically deformed, i.e., upset. In the cold rail, this is apparent from a significant curvature over the rail head 10. With the aid of a computing program, it was now computed what quantity of heat must be removed from the rail head 10 in order to ensure that it reaches the transformation line $A_{r3}/A_{r1}$ at the same time as the rail base 12. In accordance with the invention, the transformation heat of the steel (0.8% C) was taken into consideration. Based on this computation, the rail head 10 was now cooled by spraying it with water in addition to the natural convection.

Figure 4:
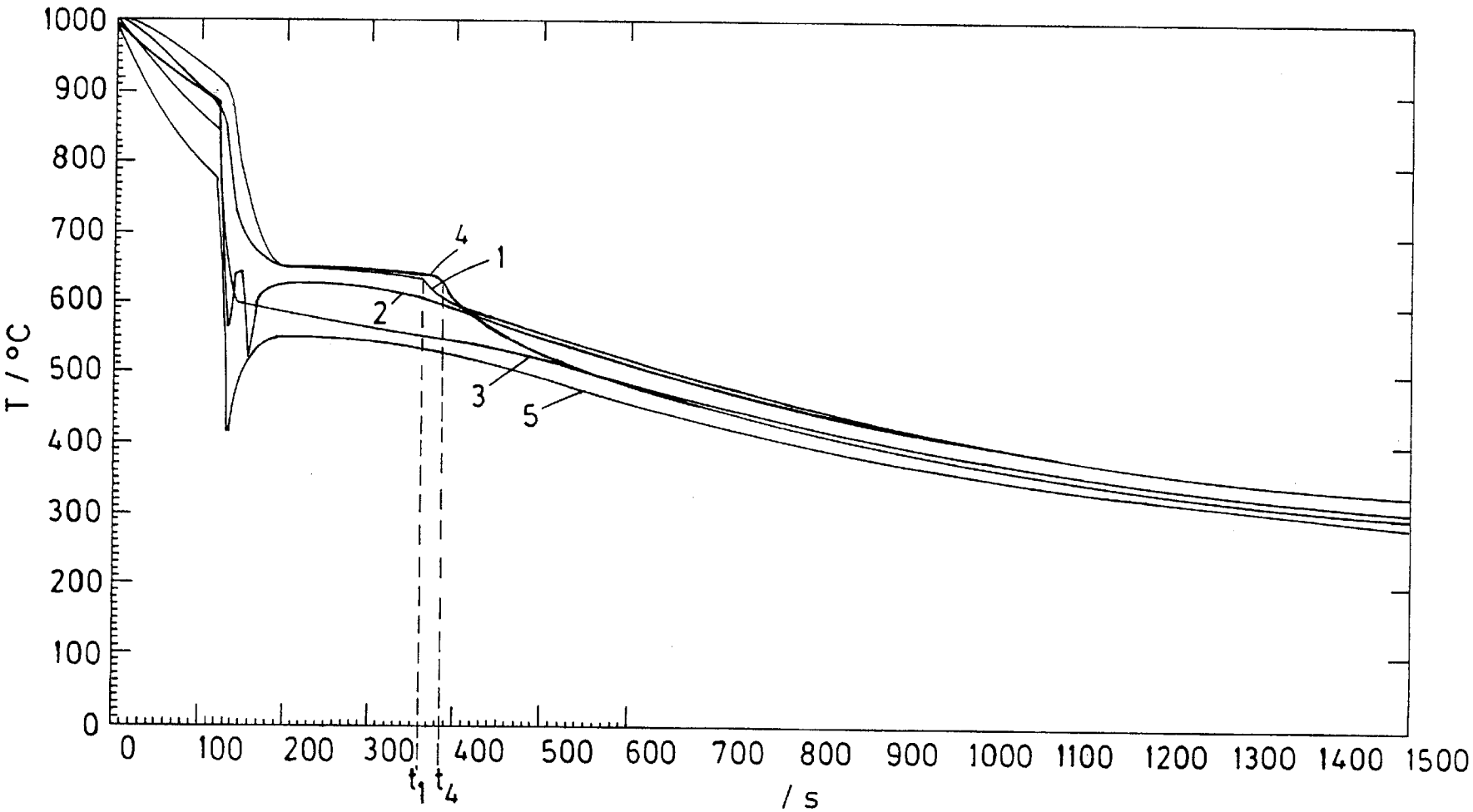
FIG. 4 is a diagram of the cooling pattern in accordance with the method of the invention.

The result is shown in the curves of the diagram of FIG. 4. The time difference in reaching the transformation temperature $t_4-t_1$ of the two curves 4 and 1 was only 25 seconds. This means that the rail head 10 and the rail base 12 reach the $A_{r3}/A_{r1}$ line almost simultaneously and the transformation is also concluded simultaneously. A large-scale experiment confirmed this procedure tested in the laboratory. This experiment also confirmed the expected result: After concluding the cooling procedure and approximately at room temperature, the rail treated in accordance with the present invention was straighter and had less stress by the factor 10 than an untreated rail.

FIG. 5 of the drawing schematically illustrates a possible embodiment of the apparatus of the present invention. The rail is mounted with its base 12 in a support 21 so that the head 10 faces downwardly. Measuring heads 30, 31, 32 are arranged in such a way that the measuring head 30 determines the heat radiation of the rail base 12, the measuring head 13 determines the heat radiation of the web 11 and the measuring head 32 determines the heat radiation of the rail head 10 and the measured values are supplied to the computing unit 40 through the data lines 33, 34, 35, respectively. In addition, the dimensions and masses of the respective section parts 10, 11, 12 are supplied to the computing unit 40 through the input data line 36. The computing unit is programmed to compute the product of temperature and mass for the individual section parts 10, 11, 12 and controls the cooling agent supply devices 45–47 through signal line 37 in dependence on the determined product. The cooling agent supply devices are activated and spray cooling agent in rays 48 against the downwardly directed rail head 10. A dash dot line 50 schematically illustrates a cooling bed which includes controllable cooling agent supply devices 45–47 for different cooling media 48. These cooling media may be water, air, or water-air/mixtures.

In accordance with the present invention, it is possible to equalize the cooling process of the rail in such a way that the principal masses, i.e., head 10, web 11 and base 12, reach the transformation line $A_{r3}/A_{r1}$ approximately at the same time and the occurring length changes of the different section parts also take place simultaneously. As a result, it is prevented that a portion of the rail section is upset or expanded. While during the subsequent cooling on the cooling bed 50 temperature differences may once again occur over the cross-section, the stresses produced during cooling are significantly below the respective yield point, so that the resulting deformations occur within the elastic range, and, consequently, a rail treated in this manner is almost without stress after cooling and approximately as straight as it was in the hot-rolled state prior to the treatment according to the invention. This is achieved in accordance with the present invention by removing a quantity of heat which has previously been computed, so that the time expired until the transformation line $A_{r3}/A_{r1}$ in the time-temperature transformation diagram is reached is at least substantially equal for all principal masses of the section, as this is clearly apparent from the comparison of FIGS. 3 and 4.

While specific embodiments of the invention have been shown and described in detail to illustrate the inventive principles, it will be understood that the invention may be embodied otherwise without departing from such principles.

We claim:

1. A method of cooling a steel section from rolling heat, wherein the section has different section parts of different masses located at a distance from each other over a cross-section of the section, the steel having a steel quality, the method comprising subjecting the steel section with a head thereof facing downwardly and a base thereof facing upwardly to a series of defined immersion procedures of a very short duration in a trough filled with water, determining and computing heat quantities to be proportionally removed from the different section parts in dependence on the masses and temperatures thereof and a quantity of cooling medium required for removing the heat by using measuring equipment together with a computing unit by means of a computer program, and subsequently carrying out cooling of the section parts in a controlled manner using short immersion procedures such that the section parts reach with as little time delay as possible the transformation line $A_{r3}/A_{r1}$ during the decomposition of the gamma-mixed crystal into ferrite and/or pearlite while releasing the transformation heat in dependence on the steel quality.

2. The method according to claim 1, comprising cooling the section over an axial length thereof with different intensity in order to compensate for any temperature wedge which is existing over the axial length of the section.

3. The method according to claim 1, comprising carrying out controlled heat removal by immersing the section at least once in a cooling medium with a predetermined cycle.

4. The method according to claim 1, comprising carrying out controlled heat removal by immersing different section parts at least once in a cooling medium with a predetermined cycle.

* * * * *